United States Patent [19]

Semjonow et al.

[11] 4,163,305

[45] Aug. 7, 1979

[54] PROCESS AND DEVICE FOR THE MANUFACTURE OF NON WOVEN WEBS FROM FILAMENTS

[75] Inventors: Valentin Semjonow, Hofheim; Jürgen Foedrowitz, Hochheim, both of Fed. Rep. of Germany

[73] Assignee: Hoechst Aktiengesellschaft, Frankfurt am Main, Fed. Rep. of Germany

[21] Appl. No.: 642,400

[22] Filed: Dec. 19, 1975

[30] Foreign Application Priority Data

Dec. 21, 1974 [DE] Fed. Rep. of Germany ..... 2460755

[51] Int. Cl.[2] ..... D01G 25/00; D04H 3/02

[52] U.S. Cl. ..... 19/299; 156/181; 156/433

[58] Field of Search ..... 156/181, 167, 433, 436, 156/439, 440, 441; 19/155, 299; 128/15 M, 72.12, 72 NW, 21; 264/168, 310 F; 425/83, 72 S; 428/371; 226/7, 97; 28/103, 289

[56] References Cited

U.S. PATENT DOCUMENTS

| | | | |
|---|---|---|---|
| 2,736,676 | 2/1956 | Frickert, Jr. | 156/181 |
| 2,875,503 | 3/1959 | Frickert et al. | 156/181 |
| 3,270,977 | 9/1966 | Tillou | 28/21 |
| 3,296,678 | 1/1967 | Bundy et al. | 28/1 |
| 3,402,227 | 9/1968 | Knee | 264/2 X |
| 3,469,796 | 9/1969 | Russell et al. | 28/289 |
| 3,736,211 | 5/1973 | Lipscomb et al. | 156/181 |
| 3,756,893 | 9/1973 | Smith | 156/181 |
| 3,853,651 | 12/1974 | Porte | 156/181 |

FOREIGN PATENT DOCUMENTS

| | | |
|---|---|---|
| 2211691 | 9/1972 | Fed. Rep. of Germany . |
| 2045331 | 2/1971 | France . |

*Primary Examiner*—Michael W. Ball

*Attorney, Agent, or Firm*—Curtis, Morris & Safford

[57] ABSTRACT

Non woven webs are produced from filaments by laying down the said filaments in the form of cone sections on a moving surface with simultaneous spreading out to a filament veil with the use of rotating deflectors coming into contact with the filaments on one side only. The deflecting area of the deflectors has a plane shape. The filaments used are drawn, partially drawn or undrawn. A non woven web with particularly good properties is obtained when the axis of the bundle of filaments and the deflecting surface of the deflector form an angle of from 10° to 80°. To produce the web a simple and reliable device is used.

25 Claims, 5 Drawing Figures

PROCESS AND DEVICE FOR THE MANUFACTURE OF NON WOVEN WEBS FROM FILAMENTS

This invention relates to a process for the manufacture of non woven webs from filaments which are collected on a moving support on which the filaments are laid in the shape of conic sections with simultaneous spreading out of the filaments to a veil with the aid of deflectors coming into contact with the filaments on one side only. The invention also relates to a device for carrying out said process.

Processes and devices of this type should be as simple as possible, work without trouble and yield a non woven fabric which is as uniform as possible and has as high a strength as possible. Numerous processes and devices have been proposed for making non wovens from filaments.

After air-jet-drawing, for example, freshly spun filaments can be spread out with the aid of electrostatic charge and laid on a moving support to form a web. It is also known to spread the filaments by using deflectors of plane, convex, or concave shape which, after impact, spread a bundle of filaments accelerated in axial direction to form a veil. It has also been proposed to direct, on the point of impact or in the vicinity thereof, a pressurized gas current to improve the unsatisfactory spreading out of the bundles of filaments by means of the deflectors. Helical deflectors have also been proposed. In the aforesaid process the bundles of filaments do not have an exact guidance when being laid so that in the non woven web the filaments are substantially in random distribution. With regard to the tangled irregular arrangement of the filaments non wovens obtained in this manner are even called disordered.

Published German Specification No. 2,048,395 describes process and a device for the manufacture of non woven webs. In this process a plurality of continuous polymeric filaments are fed to two or more gas-operated conveying devices and laid down in the interior of a hollow, tube-shaped collecting surface, from where the tube-shaped non woven webs are continuously drawn downward and wound up.

The conveying devices are directed towards the collecting surface and relative to said surface they accomplish an angular movement in such a manner that the filaments are substantially laid down in circles in a direction which is transversal to the longitudinal direction of the tube-shaped collecting surface. By the preferred laying down in transverse direction the filaments in the web are subject to a detrimental strong transverse orientation so that products are obtained which do not have a sufficient strength in longitudinal direction.

German published Specification No. 2,200,782 provides a process and a device for the manufacture of a non woven web from continuous filaments. The spun filaments are drawn off and simultaneously drawn, they are then spread out with whirling motion and laid down on a moving surface to form a non woven fabric. The spreading out of the filaments is brought about mainly by centrifugal force and aerodynamic influences. The disclosed process has, however, the drawback that the division of the bundle of filaments into two halves, effected during spreading of the filaments or occurring automatically, brings about a detrimental twisting of the filaments in upstream direction which may disturb or even stop the process.

Japanese Specification Sho-48-2902 describes a process and an apparatus for making a non woven fabric. The bundles of filaments leaving the spinneret are drawn off by a pressurized air current and a circular movement is conferred upon the filaments in a rotating device but, before the filaments are laid down, the circular movement is transformed into a straight to and fro movement. If a non woven fabric without preferred orientation of the filaments shall be produced by this process at least two layers with different orientation of the filaments have to be placed one upon the other. Such non wovens made of different layers have, of course, disadvantageous mechanical properties.

Japanese Patent Specification Sho-48-41,785 discloses a device for the manufacture of a non woven fabric which permits laying down the filaments also in swirling motion. At the lower end of a guide tube, through which the fibers or filaments are passed by means of an air current of high speed, a tube made of a flexible or stiff material is fastened in such a manner that the free end thereof can swivel and that said free end can be deflected from its resting position by centrifugal force by pivoting the guide tube including its lower end.

In this device a circular motion is conferred upon the bundle of filaments during the laydown partially by mechanical means and partially by aerodynamics. The bundle of filaments is displayed on the collecting surface but prior to the lay-down it is hardly spread out for it is hindered by its guidance in the tube and an optimum expansion of the bundle and its disintegration into smaller bundles or single filaments is hindered or at least detrimentally affected. In additional thereto, the device has a further important drawback. Almost the whole quantity of the air issuing from the draw-off nozzle in downward direction comes so near the collecting surface that whirling of the laid down filaments cannot be avoided and the filaments spread out on the support are disarranged.

Published German Specification No. 2,300,331 describes a device for making non woven webs from continuous filaments, wherein the filaments are spread out by means of a plane deflector which moves to and fro in alternating direction round it axis of fixation.

Alternating deflectors have the disadvantge that the bundles of filaments are not passed at a constant rate over the collecting surface so that webs of higher weight per unit area are obtained at the points of reversal. Vibrating deflectors have the further inconvenience that they may not function uniformly and have to be frequently adjusted. Hence, apparatus of this type is difficult to regulate and has little reliability in operation.

To produce a non woven web of the desired width individual strips issuing from several individual laydown devices are laid one beside the other in overlapping position. In order that the overlapping takes place without trouble the adjacent non woven strips are laid successively on the collecting belt. This procedure has the drawback that the cohesion between the individual strips is very weak and that the non wovens strongly tend to delaminate so that the mechanical strength of the non woven fabric essentially depends on the subsequent consolidation by needling, welding, or chemical bonding.

Hence, the known processes and devices all have drawbacks. They do not permit the production without trouble of a wide web of non woven material with optimum uniformity of the filament orientation in every direction and thus with optimum strength of the non woven web in all directions with a minimum tendency to delaminate of the non woven into the elements forming the web.

It is, therefore, the object of the present invention to provide a process and a device which do not have the aforesaid disadvantages and permit to manufacture with simple means a non woven fabric from filaments which is characterized by its anisotropy of the mechanical properties and its minimum tendency to delaminate.

This objective has surprisingly been achieved by a process for the manufacture of a non woven web from filaments collected on a moving surface by laying the said filaments on said surface in the form of conic sections with simultaneous spreading out to form a veil with the aid of deflectors which come into contact with the filaments on one side only, wherein the filaments are deflected and spread out by rotating elements with plane surface in the deflecting zone.

To carry out the process for the invention a device is used wherein the filaments are deflected and spread out with the aid of one or several rotating deflectors which come into contact with the filaments on one side only, said deflectors having a plane surface in the deflecting zone.

The filaments suitable in the process of the invention are drawn, partially drawn or undrawn and consist of linear, fiber-forming polymers such as polyesters, preferably polyethylene terephthalate, polyamides, preferably nylon 6 or nylon 66, polyolefins, preferably polypropylene or polyethylene, polyacrylonitrile, cellulose or cellulose derivatives. Filament mixtures or multicomponent filaments of the aforesaid materials may also be used. In general, the filaments used for making the non woven web are drawn. However, partially drawn and/or undrawn filaments may also be used either alone or together with drawn filaments. The partially drawn or undrawn filaments preferably act as binding filaments.

The filaments to be used can be delivered from cans or any device such as bobbins, cops, or bobbin creels. In the process of the invention the filaments are preferably delivered directly from the spinning machine as it is known from the conventional manufacture of non wovens. The filaments issuing from the spinneret are preferably drawn off and optionally drawn through jets operated with air, steam or another suitable gaseous or liquid medium, optionally drawn and simultaneously accelerated in axial direction and charged with kinetic energy so that each filament segment can reach its place provided for on the collecting area. To reach a high speed the propellant is operated at a speed up to sonic velocity or thereabove. The filaments are transported at a speed of from 100 to 10,000 m/min, preferably 2,000 to 10,000 m/min. They are passed through the draw-off and accelerating devices in the form of bundles having a titer of from 1 to 500 dtex, preferably 40 to 300 dtex, the individual filaments having a titer of from 0.5 to 20 dtex, preferably 2 to 16 dtex.

In accordance with the invention, the bundle of filaments, which is mostly accelerated vertically in downward direction in a fall tube, is directed on to a deflector rotating round its axis. Owing to the impact on the deflector the bundle of filaments is spread out and because of the revolution of the deflector the filaments are laid in circles or ellipses on a moving support.

The collecting surface which preferably advances at constant speed has a horizontal or oblique position and is preferably perforated with a suction device beneath. The bundle of filaments issuing from the fall tube hits a plane or almost plane surface of the deflector. This surface must be as plane as possible in order that the filaments are satisfactorily spread out. A concave surface or even a tube would hinder an optimum spreading out of the filaments as the possibilities of spreading out are geometrically limited. A surface with too much convex curvature would involve adjusting difficulties. Hence, optimum results are obtained with plane deflecting surfaces.

The axis of rotation of the deflector can be congruent with the longitudinal axis of the arriving bundle of filaments, but the two axes may as well be inclined with respect to each another, which feature will be dealt with below.

The axis of rotation and the deflecting surface of the deflector form an angle $\alpha$ of from 10° to 80°, which can be adjusted arbitrarily according to the inventive device. When the axis of the arriving bundle of filaments coincides with the axis of rotation of the deflector the angle $\alpha$ preferably has a value in the range of from 30° to 60°. The bundle of filaments hitting the deflecting surface at a given angle runs tangentially from the point of deflection and is spread out. The larger angle $\alpha$ the greater the angle between the two boundary lines of the spread bundle on the deflecting surface, i.e. the broader the fan. The impact and the spreading out of the bundle of filaments results in a disintegration into smaller bundles and individual filaments. The enlargement of angle $\alpha$ is, however, limited.

The bundle of flaments which has been spread out on the deflecting surface of the deflector is then laid in downward direction, first within a cone-shaped shell and then possibly within a cylinder shell, on the supporting surface. On their way down the filaments may deviate from the surface area of the cone or the cylinder towards the center so that they are laid not only in circles corresponding to the cone-shaped or cylinder shell, but also on the whole circular area corresponding to the basis of the cone or the cylinder. The size and the shape of the area on a stationary collecting surface on which the filaments of one lay-down device are laid down depend on several factors.

The deposition area has a circular shape when the longitudinal axis of the bundle of filaments hitting the deflector coincides with the axis of rotation of the deflector and both axes are in a position vertical to the horizontal collecting surface.

The size of the area essentially depends on the delivery speed of the bundle of filaments, the deflecting angle $\alpha$, the frequency of rotation of the deflector and the distance of the collecting surface from the deflector. The higher the delivery speed of the bundle of filaments with respect to the frequency of rotation of the deflector, the larger the circles in which the filaments are laid down and the larger the deposition area.

The smaller the angle of deflection $\alpha$ the more acute the cone of laydown of the filaments and the smaller the plane of section of the cone with the laydown and consequently the deposition area.

As already mentioned above, the spreading out of the filaments in the form of a cone-shaped veil may change over in a falling down of the filaments in the form of a cylindrical veil. This is the case when the distance between the deflector and the collecting surface is sufficiently large and the delivery speed is low with respect to the frequency of rotation of the deflector. Theoretically fully spread out filaments are laid down according to the following equation $$d=V/(\pi \cdot f)$$

in which d is the diameter of the circles of laydown of the filaments v is the delivery speed of the filaments and f is the frequency of rotation of the deflector.

Non woven webs of excellent strength are obtained when largely spread filaments are laid down in large circles.

Thus, the maximum size of the laydown circles and the maximum size of the basis of the conically shaped veil formed by the spread out descending filaments is equal to d. The maximum diameter of the circles limited by the above equation is the main reason for the change of the conically shaped lay-down of the filaments into a cylindrical laydown. It should be taken into consideration, however, that with large distances between the deflector and the collecting surface the gravity and the consumption of the kinetic energy also contribute to a small extent to the exchange of the veil of filaments into a cylindrical shape.

When the longitudinal axis of the bundle of filaments hitting the deflector and the coincident axis of rotation of the deflector are not positioned in vertical direction with respect to the horizontal collecting surface, the filaments are not laid down in circles but in the form of ellipses. In this case the laid down filaments are increasingly oriented in the direction of the great axis of the ellipse. The process of the invention thus permits to confer upon the laid down filaments a preferred orientation in any desired direction.

The distribution of the filaments within the circular or elliptical deposition or collecting zones can be influenced by the delivery speed of the filaments, the deflecting angle $\alpha$, the frequency of rotation f of the deflector and the distance of the deflector from the collecting surface. The distribution of the filaments on the collecting surface can also be influenced by a helical deflector surface below the point or zone of impact of the bundle of filaments. The distribution of the filaments obtained with a definite selection of the parameters is extremely constant with respect to time and geometry, whereby the uniformity of broad non woven webs formed by several overlapping strips is favored.

If the longitudinal axis of the bundle of filaments does not coincide with the axis of rotation of the deflector but the two axes are inclined with respect to each other and form an angle $\beta$ and if, at the same time, the axis of rotation of the deflector is not in vertical position on the collecting surface, the filaments are not laid down in circles or ellipses. Depending on the angle $\beta$ of the two axes and depending on the angle $\alpha$ indicating the inclination of the deflecting surface relative to the axis of rotation of the deflector, the bundle of filaments is deflected in two different ways. In one case, the bundle of filaments is delected to all sides regarded from the axis of rotation of the deflector, the axis of rotation is within the cone of filaments and, in the other case, the bundle of filaments is deflected to one side of the axis of rotation of the deflector only and the axis of rotation of the deflector is outside of the cone of filaments. The filaments depositions are then neither circular nor elliptical but have a different shape.

The angles $\alpha$ and $\beta$ are the corresponding acute angles.

There is valid the genral relation $0° < \alpha < 90°$ (1). But for practical reasons the angle $\alpha$ should be within the limits of $$10° \leqq \alpha \leqq 80°.$$

The angles $\alpha$ and $\beta$ cannot be chosen or combined voluntarily. A definite angle $\alpha$ only permits definite angles $\beta$ and vice versa. Therefore, the following general relation exists $$\alpha > \beta \qquad (2)$$

When the axis of rotation of the deflector shall be within the cone of filaments the relations (1) and (2) are further restricted by the relation $$\alpha < 90° - \beta$$

and when the axis of rotation of the deflectors shall be outside of the cone of filaments the relation is $$\alpha > 90° - \beta$$

A single lay-down device yields a non woven web which is not satisfactory in several respects, for example the web has a limited width. It is therefore advantageous to arrange several lay-down devices side by side, preferably in one or more parallel rows above the collecting surface, preferably in transverse position with respect to the moving direction of the collecting surface. The individual lay-down devices of adjacent rows may also be in staggered position. The angle formed by the rows and the moving direction of the collecting surface may also be different from 90°. The individual lay-down devices have a distance from one another of about 5 to about 100 cm, preferably 10 to 70 cm. The shortest distance is determined by the space required for each unit, while the largest distance depends on the breadth of the single area of filament deposition. The shorter the distance between the individual lay-down areas, the larger the overlapping of the individual depositions in the non woven web. The number of overlapping individual depositions Z depends not only on the lateral distances e of the units from one another but also on the width of the depositions b, the valid relation being $$Z=b/e$$

The deflectors of the individual lay-down devices run synchronous in such a manner that the deflecting surfaces are preferably in parallel planes so that the arriving bundles of filaments are deflected at any moment from all deflectors in the same direction, whereby the individual adjacent filament depositions disturb one another to a minimum extent only, although the filament veils delivered from vicinal devices repeatedly intermesh. The diameter of one filament deposition may be a multiple of the distance between neighboured individual lay-down devices. In this manner extremely uniform non woven webs are obtained, especially with respect to the mass distribution in the plane.

By the alternating superposition of the individual filament depositions of the bundles of filaments spread out in the form of individual filaments and smaller bundles by adjacent devices there is achieved not only an overlapping as it is known from conventional non wovens, but also a precise interlacing of the individual layers free from accidentalness. This is the reason why the non woven web according to the invention has an extremely low tendency to delaminate.

After spreading out and laying down of the filaments the non woven web formed is consolidated in known manner by needling, or calendering with or without the action of heat.

The device according to the invention will now be described by way of example with reference to the accompanying drawings in which FIG. 1 represents a single lay-down device.

Figure 1:
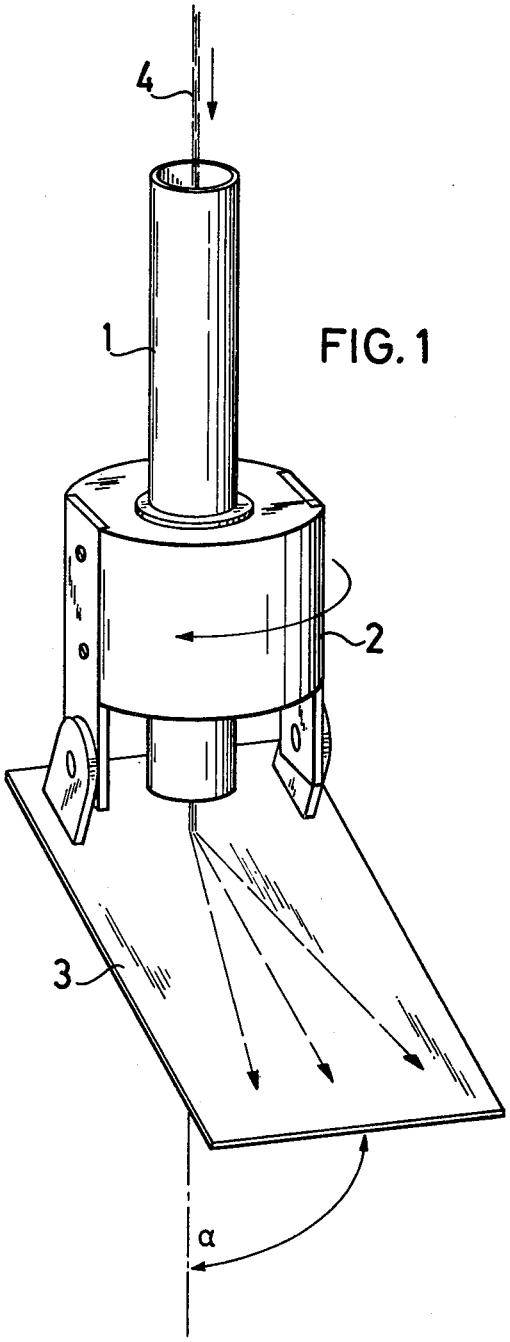

Referring to FIG. 1, a lay-down device consists of a fall tube 1 and a rotor 2. The bundle of filaments 4 is delivered through the fall tube 1 in the direction of the arrow and, after having left tube 1, it hits deflector 3, which is an element of rotor 2. On the deflector 3 the bundle of filaments 4 is spread out as indicated by the arrows. Owing to the rotary motion of the rotor 3 in the direction of the arrow and therewith of the deflector 3, the spread out bundle of filaments 4 is laid down in the form of a cone and collected on a surface not shown.

Figure 2:
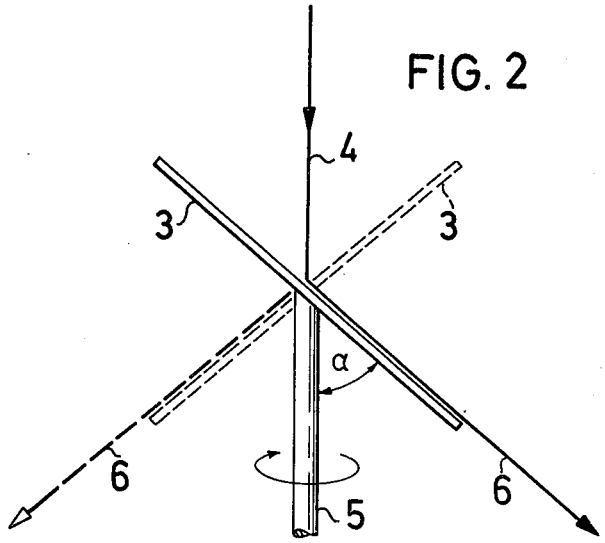
FIGS. 2 and 3 illustrate different positions of the axis of rotation of the deflector with respect to the longitudinal axis of the bundle of filaments.
Figure 2:
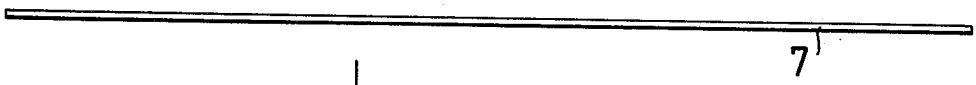

According to FIG. 2, the longitudinal axis of the bundle of filaments 4 hitting the deflector 3 conicides with the axis of rotation 5 of the deflector 3. In this case the angle $\beta$ is zero and the axis of rotation of the deflector lies within the cone of filaments 6. The collecting surface 7 is in horizontal position.

Figure 3:
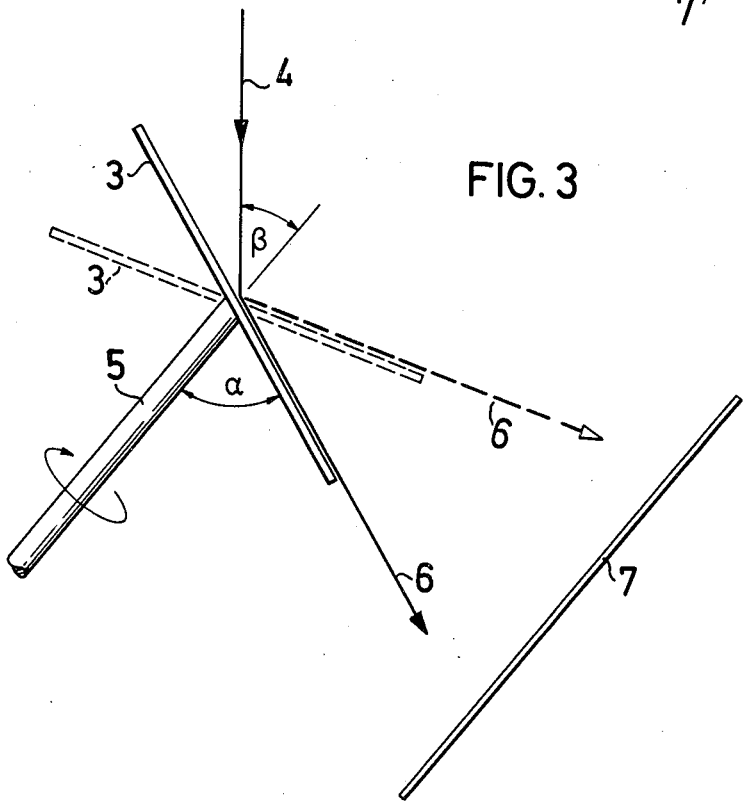

According to FIG. 3 the longitudinal axis of the bundle of filaments 4 hitting the deflector 3 forms an angle $\beta$ with the axis of rotation 5 of the deflector. It can be seen that in this case the axis of rotation 5 of the deflector 3 is outside of the cone of filaments. The collecting surface 7 has an inclined position.

Figure 4:
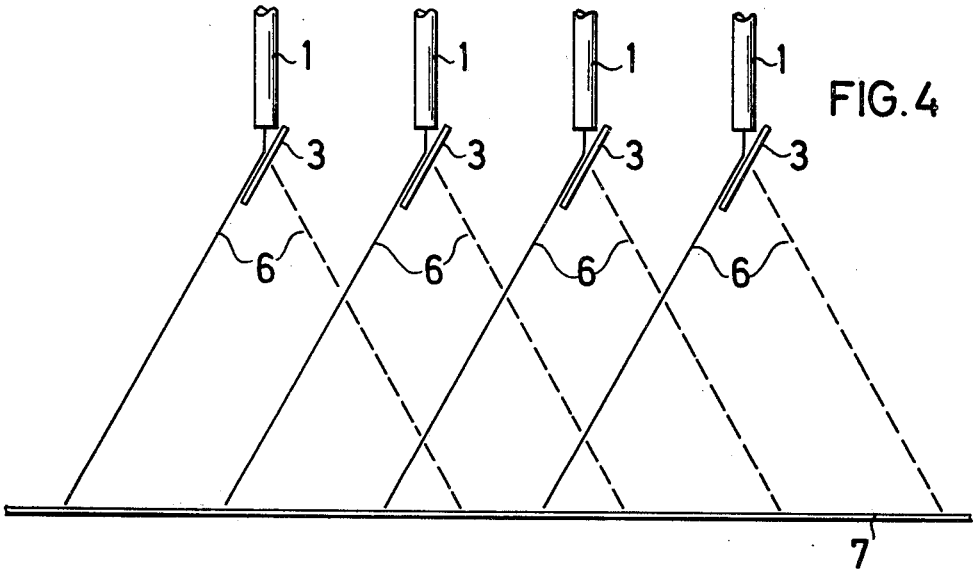
FIG. 4 shows an arrangement of several lay-down devices side by side.

FIG. 4 is a simplified representation of a plurality of lay-down devices. The bundles of filaments delivered through fall tubes 1 are spread out to form cones by the rotating deflectors 3. The figure shows that the filament cones 6 intermesh with one another with a large overlapping and interlacing. FIG. 4 also shows that with a synchronous run and phase coincidence of the rotors or deflectors the bundles of filaments of adjacent devices are laid down without disturbing one another. On their way from the deflector to the collecting surface the filaments touch one another neither when they are deflected to the left (full line) nor to the right (dotted line).

Figure 5:
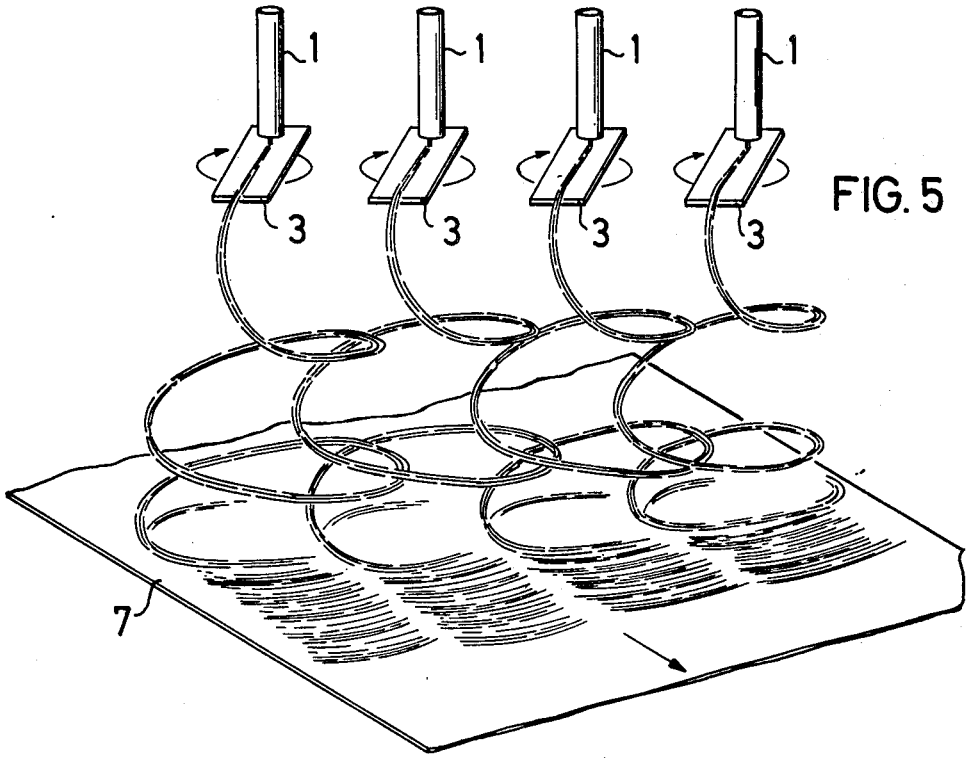
FIG. 5 is a perspective view of the arrangement illustrated in FIG. 4.

The perspective illustration of FIG. 5 particularly illustrates the interlacing of adjacent individual filament layers or loops of filaments.

The non woven webs produced by the process of the invention can be used for many purposes, especially in industry. They are suitable, for example, as base material for coating and tufting, they can be used as reinforcing interlayers, for making needled non wovens and in building industries.

The following example illustrates the invention:

EXAMPLE

To produce a non woven web, 6 bundles of polyethylene filaments were extruded and drawn in jets operated with compressed air, deflected and spread out by devices according to the invention and collected on a moving surface. Sic lay-down devices were arranged in one row transverse to the moving direction of the collecting surface at a distance of 18 cm. Each bundle of drawn filaments had a titer of 96 dtex and consisted of 12 filaments with an individual titer of 8 dtex each. By the gas jets the bundles of filaments were accelerated to a speed of 4,000 m/min and passed through the fall tubes vertically on the plane deflectors. The axis of rotation of the deflectors coincided with the longitudinal axis of the bundles of filaments and were in vertical position relative to the collecting surface. The plane deflecting surfaces of the deflectors formed an angle of 50° with the axis of rotation of the deflectors. The deflectors rotated at a frequency of 12 cycles per second. The points of impact of the bundles of filaments on the deflectors were 52 cm above the collecting surface. The speed of the perforated collecting belt with suction device beneath was regulated in such a manner that the non woven web had a weight of 100 g/m$^2$.

The laid down non woven web was then calendered under a pressure of the rolls of 75.0 kg/cm and at a temperature of the rolls of 120° C.

The web obtained was subsequently impregnated with a dispersion of arcylic binder whereby the weight of the non woven fabric was augmented to 115 g/m$^2$. The non woven fabric obtained was found to have the following properties:

tensile strength in longitudinal direction—43.0 kg/5 cm
elongation at break—38%
tensile strength in transverse direction—41.0 kg/5 cm
elongation at break—41%

To determine the maximum variation of the filament distribution the edges of the non woven web were cut off and in a piece of 2 square meters three of the thinnest and three of the thickest areas were visually chosen and each time pieces of 5×5 cm were cut out. By weighing of the cuttings the highest and the lowest weight were determined, from which the deviation of the weight per square meter was calculated in percent relative to the average weight per square meter of the non woven fabric. By adding the two deviations the maximum variation of the uniformity of the non woven web was determined.

The thinnest area had a weight of 93 g/m$^2$ which corresponded to a deviation of 19% from the average weight per square meter and the thickest area had a weight of 134 g/m$^2$ corresponding to a deviation from the average weight per square meter of 16%, the maximum variation of the uniformity thus being 35%.

Comparative Example

Instead of the rotating plane deflectors of the invention the same number of conventional deflecting plates was used, which plates were moved to a fro round their axis of fixation at a frequency of 1 cycle per second. The other conditions were the same as above. The non woven fabric obtained was calendered, impregnated and dried as described above. The non woven web obtained had the following properties:

tensile strength in longitudinal direction 31.0 kg/5 cm
elongation at break—40%
tensile strength in transverse direction—35.0 kg/5 cm
elongation at break—46%
maximum variation of the uniformity of filament distribution—65%

The results show that the non woven fabric according to the invention had a good strength and a much better uniformity as indicated by the weight per square meter and the strength in longitudinal and transverse direction of the web.

What is claimed is:

1. The process for the manufacture of non-woven webs from filaments collected on a moving surface by laying down said filaments on the moving surface in the form of conic spread sections, which method comprises deflecting and spreading out the filaments of a plurality of bundles of filaments to form filament veils laid down on said moving surface by continuously deflecting said bundles of filaments against one side only of associated filament deflectors, each deflector having a plane surface located at an angle to its associated bundle of filaments defining said one side and against which its associated bundle of filaments is deflected, and continuously rotating said deflectors with their plane surfaces at an angle to said filaments whereby the filaments in the bundles are deflected, dispersed and spread apart from one another into smaller bundles and individual fibers laid down on said moving surface.

2. The process of claim 1, wherein the non woven web is made from drawn filaments of fiber-forming polymers.

3. The process of claim 1, wherein polyester filaments are used.

4. The process of claim 1, wherein the filaments are accelerated in gas jets to a speed of from 100 to 10,000 m/min.

5. The process of claim 1, wherein the filaments hit the deflector at an angle such that the axis of the bundle of filaments and the deflecting surface of the deflector form an angle of from 10° to 80°.

6. The process of claim 1, wherein the filaments hit the deflector at an angle such that their longitudinal axis coincides with the axis of rotation of the deflector.

7. The process of claim 1, wherein the filaments hit the deflector in a direction vertical to the collecting surface.

8. The process of claim 7, wherein the individual filament depositions have a circular shape.

9. The process of claim 1, wherein the filaments hit the deflector at an inclined angle to the collecting surface.

10. The process of claim 9, wherein the individual filament depositions have an elliptical shape.

11. The process of claim 1, wherein the longitudinal axis of the bundle of filaments hitting the deflector does not coincide with the axis of rotation of the deflector and the axis of rotation of the deflector is not vertical to the collecting surface.

12. The process of claim 11, wherein the axis of rotation of the deflector is within the cone-shaped veil of filaments.

13. The process of claim 11, wherein the axis of rotation of the deflector is outside of the cone-shaped veil of filaments.

14. The process of claim 1, wherein adjacent lay-down devices deposit filaments in partially common zones of the collecting surface.

15. The process of claim 1 wherein the filaments of adjacent lay-down devices intermesh on each turn of the deflectors.

16. In a device for the manufacture of non-woven webs from filaments collected on a moving surface by laying down said filaments on the moving surface the improvement comprising at least one rotatable deflector positioned to contact a filament bundle on one side only to deflect the bundle and disperse and spread out the filaments therein from one another into smaller bundles and individual filaments, said deflector having a flat planar deflecting surface and means for rotating said deflector continuously through 360° for forming conic spread apart filament sections deposited on said moving surface.

17. The device of claim 16, comprising means for adjusting the angle between the axes of rotation of the deflector and the deflecting surfaces.

18. The device of claim 16, wherein the axis of rotation of the deflectors and the collecting surface form an angle of 90°.

19. The device of claim 16, wherein the axis of rotation of the deflectors and the collecting surface form an inclined angle.

20. The device of claim 16, wherein several lay-down devices are arranged in a straight row.

21. The device of claim 16, wherein several lay-down devices are arranged in several parallel rows.

22. The device of claim 21, wherein the lay-down devices of the parallel rows are in staggered position.

23. The device of claim 21, wherein the rows of lay-down devices are in transverse position with respect to the moving direction of the collecting surface.

24. The device of claim 16, wherein the deflecting surfaces of the rotating deflectors are in parallel position with respect to one another.

25. The device of claim 16, wherein the deflecting surfaces of adjacent rotating deflectors have a phase angle difference.

* * * * *